US005184802A

United States Patent [19]

Galumbeck

[11] Patent Number: 5,184,802

[45] Date of Patent: Feb. 9, 1993

[54] WIRE GRID FOR BOX SPRING BEDDING ASSEMBLY

[75] Inventor: Michael Galumbeck, Columbia, Md.

[73] Assignee: Hickory Springs Manufacturing Company, Hickory, N.C.

[21] Appl. No.: 627,030

[22] Filed: Dec. 13, 1990

[51] Int. Cl.[5] ..... F16F 3/00

[52] U.S. Cl. ..... 267/103; 5/267; 5/478

[58] Field of Search ..... 5/245, 247, 252, 257, 5/267, 275, 276, 475, 478; 267/100, 101, 103, 104, 106

[56] References Cited

U.S. PATENT DOCUMENTS

Re. 12,768 3/1908 Pennepacker ..... 5/257
3,660,854 5/1972 Garceau ..... 5/267
3,953,903 5/1976 Lawrence et al. ..... 5/276
4,236,262 12/1980 Spiller ..... 5/257
4,426,070 1/1984 Garceau et al. ..... 5/267

*Primary Examiner*—Robert J. Oberleitner
*Assistant Examiner*—Chris Schwartz
*Attorney, Agent, or Firm*—Shefte, Pinckney & Sawyer

[57] ABSTRACT

An improved wire grid for connecting an array of coil springs in a box spring assembly includes perpendicularly-connected lengthwise-extending and widthwise-extending wires with the widthwise-extending wires arranged in sufficient number of possible groupings, each of three successively adjacent wires, spaced along the length of the grid to enable the grid to accept plural differing arrays of coil springs by utilizing varying combinations of the wire groupings for use of the grid without modification in box spring assemblies having differing spring-supporting base frame constructions.

7 Claims, 5 Drawing Sheets

WIRE GRID FOR BOX SPRING BEDDING ASSEMBLY

BACKGROUND OF THE INVENTION

The present invention relates generally to box spring bedding assemblies of the type adapted for use as a mattress foundation and, more particularly, to a wire grid for use in such a box spring bedding assembly to support an array of coil springs.

Conventional box spring bedding assemblies are of a relatively common uniform construction having a rectangular base frame on which a spaced array of multiple coil springs are mounted in upstanding disposition in a spaced array, with a correspondingly rectangular wire grid connected to a top coil of each spring, the entire construction being upholstered with a suitable fabric or other appropriate covering. Typically, the base frame is fabricated of wood, having a rectangular outer sub-frame with a longitudinal frame member extending the length of the sub-frame midway across its width and with a plurality of lateral frame members, commonly referred to as slats, extending widthwise across the sub-frame in parallel relation to one other at spacings along the length of the sub-frame. The plural coil springs of the box spring assembly are arrayed in widthwise-extending parallel rows across the lateral slats and the laterally-extending end members of the sub-frame.

Conventional box spring assemblies of this basic construction have traditionally been manufactured in varying grades, differentiated primarily according to the number of coil springs incorporated in the box spring assembly which correspondingly affects the overall firmness and anticipated useful life of the box spring assembly. Typically, a greater number of slats are provided in the base frame of box spring assemblies which are to incorporate a greater number of coil springs. For example, with box spring assemblies of a stand size commonly called "full size", many manufacturers produce box springs in three differing grades utilizing three differing base frame constructions each with a differing number of lateral slats (e.g., six, seven, or eight slats) in order to achieve differing arrays of differing numbers of coil springs for varied degrees of firmness. Similarly, box spring assemblies in other sizes commonly referred to as "twin", "queen", and "king" (i.e, two "twin" box springs) sizes, are also commonly produced in differing grades generally differentiated only by the number of slats and springs utilized in the box spring.

Since the base frame of such box spring assemblies are constructed of wood, a manufacturer's fabrication of three or more differing box spring structures with differing numbers of slats does not significantly increase the manufacturer's overall costs in comparison to the costs associated with producing one grade of box spring. However, on the other hand, each differing box spring construction requires a differing wire grid to interconnect the top coils of the particular array of coil springs, which does significantly increase the manufacturer's costs since such wire grids cannot be as easily and inexpensively manufactured in differing construction. Typically, such wire grids are acquired by box spring manufacturers from a third party, necessitating that the manufacturer maintain separate inventories of each differing wire grid, whereas in contrast the box spring manufacturer would typically fabricate the base frames itself from stock pre-cut wooden frame members and slats which do not vary in size from one grade of box spring to another.

SUMMARY OF THE INVENTION

It is accordingly an object of the present invention to provide a wire grid for use in a box spring bedding assembly, with an improved construction enabling the grid to be used without modification in varying box spring assemblies of differing base frame constructions, thereby to overcome the aforedescribed problems.

Briefly summarized, the wire grid of the present invention basically comprises a plurality of relatively rigid longitudinal wires and a plurality of relatively rigid transverse wires, wherein the longitudinal wires are arranged in spaced parallel relation to one another and rigidly connected to the longitudinal wires in substantially perpendicular relation thereto, thereby to form the grid in an overall rectangular configuration. The transverse wires are further arranged to provide a plurality of possible groupings of adjacent wires spaced along the length of the grid, with the wires of each grouping being cooperative with one another for connection thereto of a plurality of coil springs laterally spaced across the width of the grid. According to the present invention, the number of such groupings is sufficient to enable the grid to accept a plurality of differing arrays of coil springs utilizing varying combinations of the wire groupings for use of the grid without modification in varying box spring assemblies.

In the preferred embodiment, the wire groupings are arranged relative to one another for use of the wire grid with a plurality of differing box spring frames having differing numbers of widthwise-extending slats at differing spacings from one another. For this purpose, it is preferred that the wire groupings are more closely spaced to one another in a central region along the length of the grid than in end regions at the opposite ends of the grid to permit a greater concentration of coil springs to be mounted in the central region. Preferably, each wire grouping is arranged for interlocking engagement with an end coil of each coil spring connected thereto. For example, each wire grouping may comprise a set of three adjacent wires for engagement of end coil of a coil spring at one side of the intermediate wire and at the opposite side of the other two wires, thereby to secure the coil spring to the wire groupings.

DESCRIPTION OF THE PREFERRED EMBODIMENT

Figure 1:
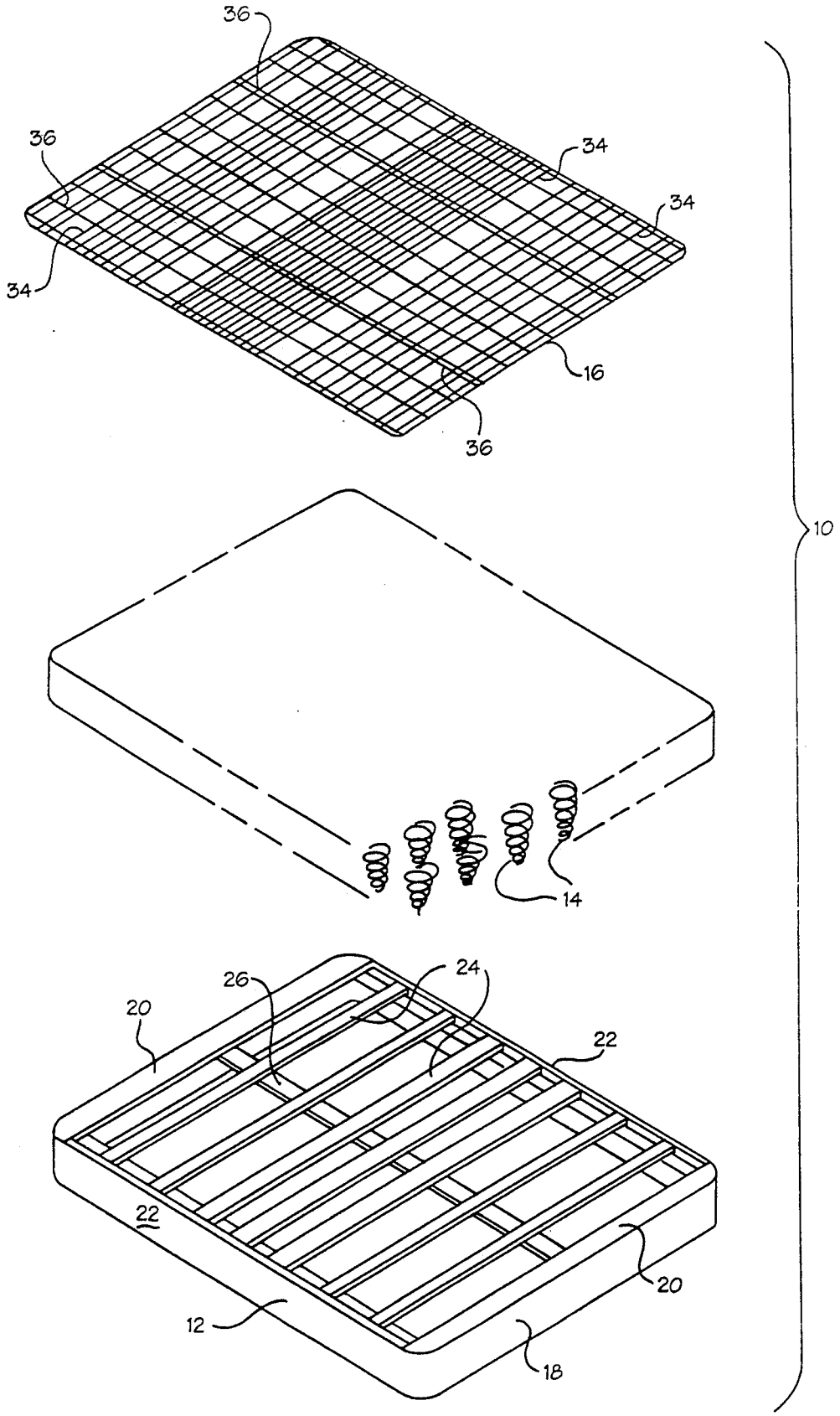
FIG. 1 is an exploded perspective view of the internal components of a box spring bedding assembly incorporating a wire grid according to the preferred embodiment of the present invention.

Referring now to the accompanying drawings and initially to FIG. 1, a box spring assembly, excluding any upholstering or outer covering, is shown in exploded form and broadly indicated at 10, the box spring assembly 10 basically including a rectangular base frame 12 on which an array of individual coil spring units 14 are supported in upstanding disposition with a correspondingly rectangular wire grid 16 according to the preferred embodiment of the present invention connected respectively to the top coils of the spring units 14.

The base frame 12 is of a substantially conventional construction fabricated of wooden boards. Specifically, the base frame 12 includes an outer rectangular sub-frame 18 formed of a spaced parallel pair of widthwise-extending end frame members 20 affixed at their respective ends in perpendicular end-to-end relation to a pair of spaced parallel lengthwise-extending side frame members 22. A plurality of widthwise-extending substantially flat support slats 24 are affixed at their respective ends to the side frame members 22 to extend therebetween in spaced parallel relation along the length thereof. An elongate stabilizing member 26 extends the length of the sub-frame 18 at substantially its widthwise midpoint and is affixed to the underside of each end frame member 20 and each slat 24, thereby to rigidify the sub-frame 18. By this construction, the upper surfaces of the end frame members 20 and the slat 24 substantially lie in a common plane to provide weight-bearing surfaces for the coil spring units 14.

The spring units 14 may be of substantially any conventional construction commonly utilized in box spring assemblies or any other suitable spring construction providing appropriate spring characteristics. The illustrated spring units 14 are representative of a common type of conventional coil-type spring unit utilized in many conventional box spring bedding assemblies. Each spring unit 14 is fabricated of a continuous length of resilient spring wire formed in a series of circular coils 28, the top coil 28' being relatively enlarged and closed by a knot tying the upper free end of the spring wire to the next adjacent coil 28, as indicated at 30, and the bottom coil 28'' being open to leave the opposite bottom free end 32 of each spring wire exposed. In this manner, each spring unit 14 may be rigidly secured in upstanding disposition on the sub-frame 18 by affixing the free end 32 of the bottom spring coil 28 to the upper support surface of one of the slats 24 or the end frame members 20 utilizing a staple, clip, or other suitable fastener 31. With the array of plural spring units 14 mounted to the base frame 12 in such manner, the top coils 28' of the spring units 14 substantially lie in a common plane.

The grid 16 is formed of two sets of relatively rigid wires 34,36 welded or otherwise affixed to one another with the wires of each set in spaced parallel relation to one another and in substantially perpendicular relation to the wires of the other set. In this manner, the grid 16 is of an overall substantially rectangular configuration corresponding in widthwise and lengthwise dimensions to the rectangular base frame 12. According to the present invention, as more fully explained below, at least some of the widthwise-extending grid wires 34 are arranged at sufficiently close spacings to one another to provide multiple groupings of three successively-adjacent wires 34, as representatively indicated at 38, which groupings 38 correspond in parallel spaced relation to one another lengthwise of the wire grid 16 to the spacing of the slats 24 and end frame members 20 of the base frame 12 to directly overlie the slats 24 and end frame members 20 for connection of the top coils 28' of the spring units 14 respectively to the wire groupings 38.

Figure 2:
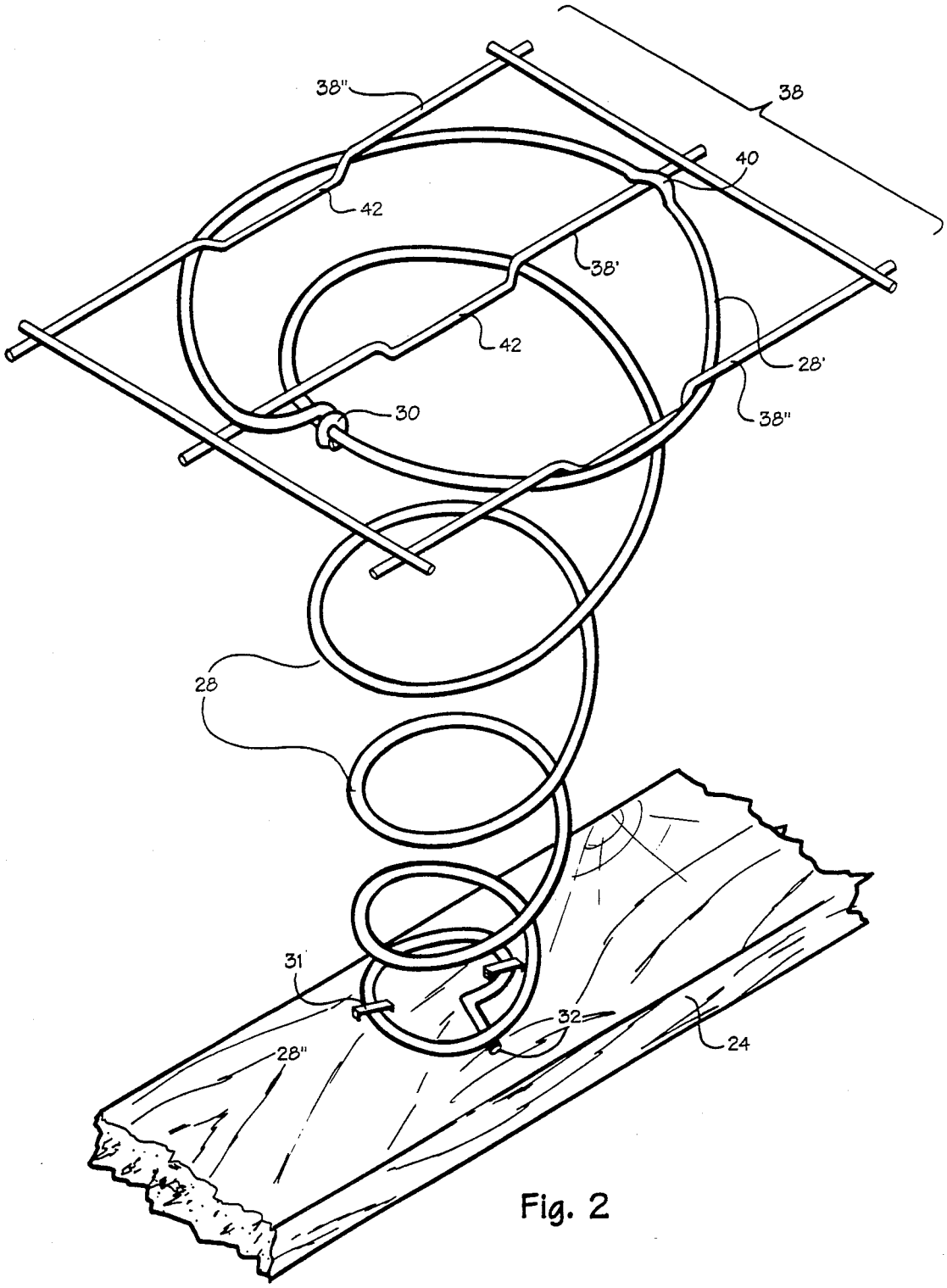
FIG. 2 is an enlarged perspective view of one spring unit and a portion of the wire grid of the box spring bedding assembly of FIG. 1, illustrating the manner of assembly thereof.

More specifically, as shown in FIG. 2, the top coil 28' of each spring unit 14 is engaged with a respective grouping 38 of the grid wires 34 by disposition of the top coil 28' with a medial portion thereof extending over the intermediate wire 38' of the groupings 38 and with opposite lateral portions of the top coil 28' extending under the other two wires 38'' of the grouping 38 at opposite sides of the intermediate wire 38'. The undersurface of the top coil 28' of each spring unit 14 may be formed with a notch 40, preferably generally diametrically opposite the wire knot 30 for engagement of the intermediate wire 38' in the notch 40 as well as between the top coil 28' and the next adjacent coil 28 of the spring unit 14 adjacent the knot 30 to rigidify the connection of the top coil 28' to the wire grouping 38. Additionally, each grid wire 34 may be formed with downwardly extending segments 42 at corresponding locations for secure engagement of the segments 42 in each outer wire 38'' of each wire grouping 38 with the lateral portions of the top coil 28' of each spring unit 14, to further rigidify the mounting of each top coil 28' to the grid 16.

Figure 3:
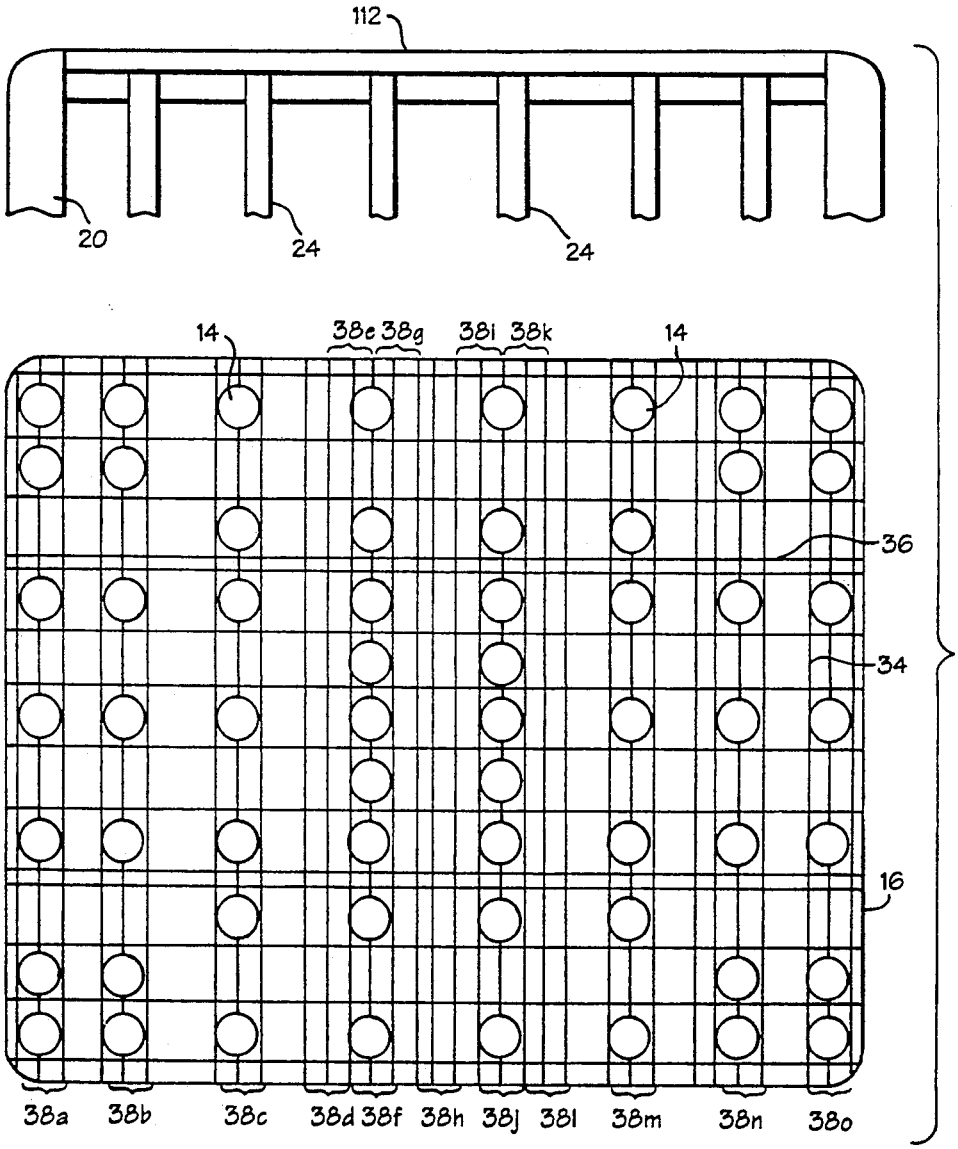
FIGS. 3, 4, and 5 are schematic plan views respectively illustrating the various use of the present wire grid of FIG. 1 in box spring assemblies of differing constructions utilizing differing numbers of widthwise-extending slats.
Figure 4:
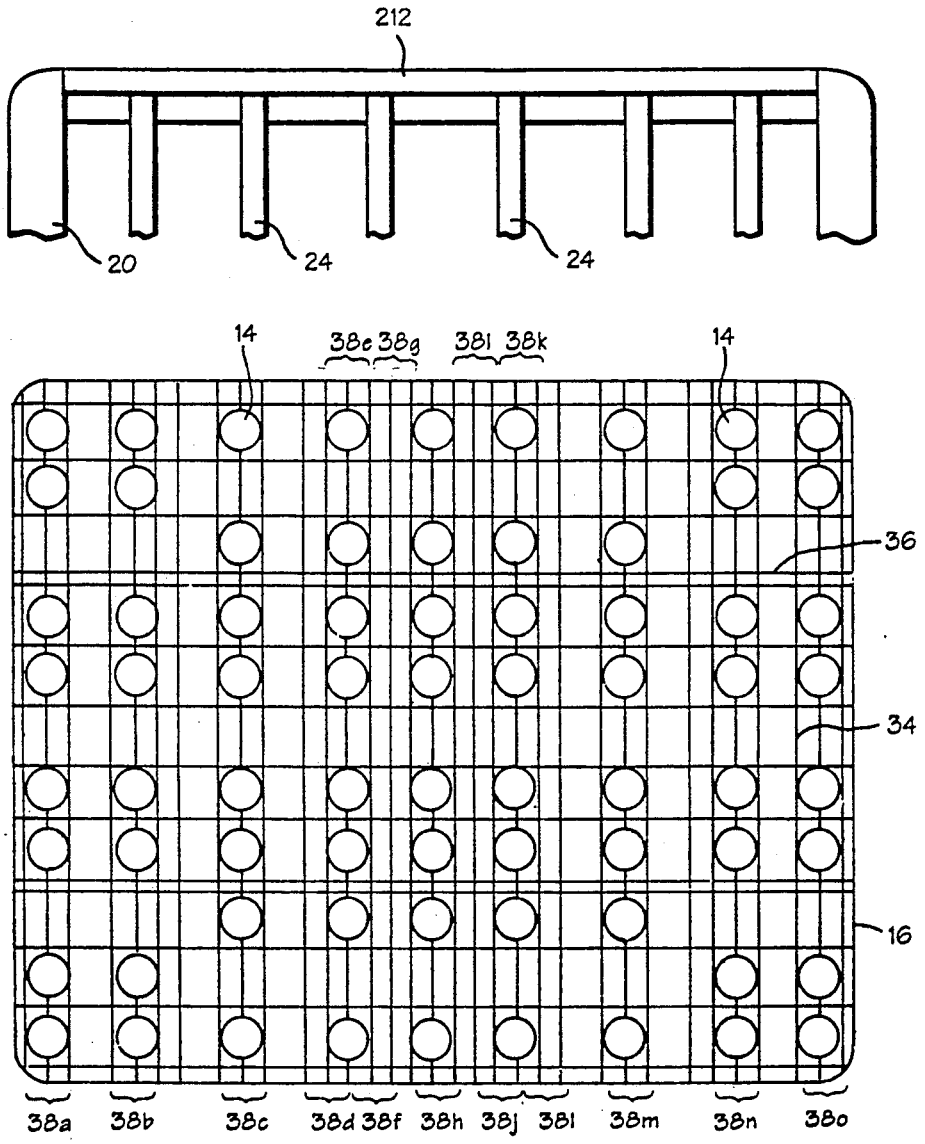
Figure 5:
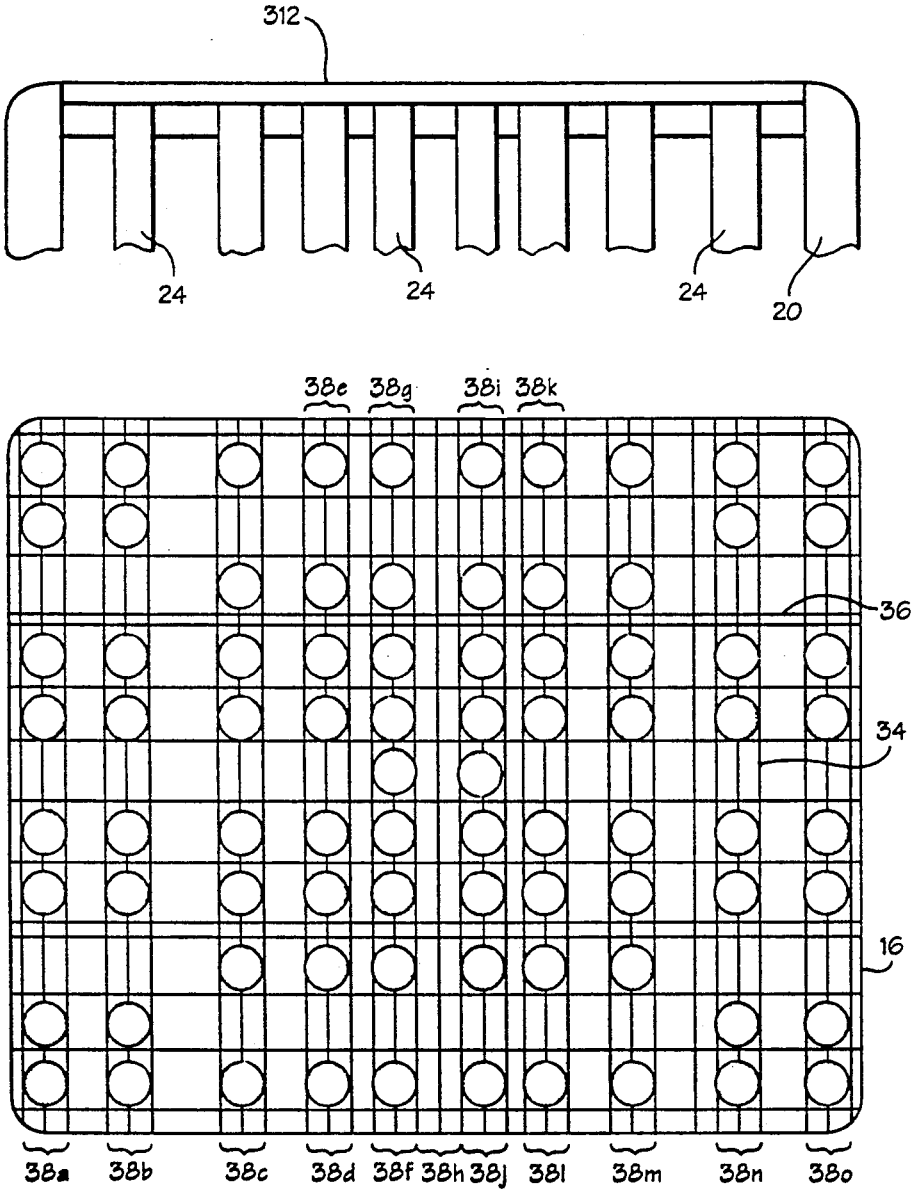

According to the present invention, the wire grid 16 is constructed with its grid wires 34 spaced relative to one another to provide a sufficient number of possible groupings 38 each of three grid wires 34, to enable the grid 16 to be employed without modification in various box spring assemblies having base frames 12 of differing constructions, particularly differing grades of conventional box spring assemblies of differing grades utilizing differing numbers of support slats 24, as best seen and understood with reference to FIGS. 3-5. By way of example, FIGS. 3-5 illustrate schematically conventional constructions of box spring base frames 12 commonly utilized in differing grades of standard full-size box spring assemblies, FIG. 3 illustrating a base frame 112 having six spaced slats 24 such as typically provided in many budget-grade standard full-size box spring assemblies, FIG. 4 illustrating a base frame 212 having seven slats 24 such as provided in medium grade standard full-size box spring assemblies, and FIG. 5 illustrating a base frame 312 having eight slats 24 representative of many premium-grade standard full-size box spring assemblies.

As will be recognized by comparison of the base frames 112, 212, 312, the respective end frame members 20 and slats 24 thereof define, within the same rectangular dimensions of a standard full-size box spring assembly, a total of fifteen different locations for widthwise-extending rows of coil spring units 14; hence, the wire grid 16 of the present invention provides fifteen corresponding possible groupings 38 of grid wires 34, indicated in FIG. 3 at **38*a* through 38*o*. Of course, persons skilled in the art will recognize that the respective slats 24 and end frame members 20 of the base frames 112 and 212 define together a total of eleven different locations for widthwise coil spring rows and the slats 24 and end frame members 20 of the base frames 212 and 312 define together a total of thirteen different widthwise coil spring row locations. Thus, a wire grid intended for interchangeable use with only the base frames 112 and 212 would need to provide only eleven corresponding wire groupings 38 and a wire grid interchangeably usable with only the base frames 212 and 312 would have to provide only thirteen corresponding wire groupings 38**.

As will be recognized, in the central region along the length of the wire grid 16, the grid wires 34 are arranged to provide a closer spacing of the wire groupings 38 relative to one another than at the opposite ends of the grid 16 such that certain individual grid wires 34 may serve as part of two different wire groupings 38, thereby to permit a greater concentration of coil spring units 14 to be mounted in this central region of the grid 16 to accommodate the slat locations of each of the base frames 112, 212, 312.

As will be thus understood, when the present wire grid 16 is utilized with the base frame 112 of FIG. 3, the wire groupings 38*a*, 38*b*, 38*c*, 38*f*, 38*j*, 38*m*, 38*n*, and 38*o* are employed to connect the top coils 28' of the spring units 14 mounted on the base frame 112, regardless of the particular array of the spring units 14. In use of the present wire grid 16 with the base frame 212 of FIG. 4, the wire groupings 38*a*, 38*b*, 38*c*, 38*e*, 38*h*, 38*k*, 38*m*, 38*n*, and 38*o* are employed to connect the spring units 14 to the grid 16. On the other hand, when the present grid 16 is employed with the base frame 312 of FIG. 5, the wire groupings 38*a*, 38*b*, 38*c*, 38*d*, 38*g*, 38*i*, 38*l*, 38*m*, 38*n*, and 38*o* are employed to connect the spring units 14 to the grid 16.

FIGS. 3–5 illustrate representative arrays of spring units 14 which are made possible by use of the present wire grid 16 in conjunction with the base frames 112, 212, 312, respectively, the particular locations of the spring units 14 in each Figure being only schematically indicated by blackened circles for sake of simplicity of illustration. However, it is to be understood that the illustrated arrays of spring units 14 are only exemplary many other spring arrays being possible with the present wire grid 16.

Thus, while FIG. 3 illustrates a box spring assembly wherein sixty coil spring units 14 are supported between the six-slat base frame 12 and the wire grid 16, it would be equally possible to provide a more limited array of only forty-eight coil spring units 14 arranged in eight widthwise-extending rows of six spring units each or, alternatively, a more extensive array of eighty-eight coil spring units 14 arranged in eight widthwise-extending rows of eleven spring units each, as well as other varying alternative arrays. Likewise, while FIG. 4 illustrates a possible array of seventy-two coil spring units 14, it would be equally possible utilizing the grid 16 of the present invention to provide a more limited array of fifty-four coil spring units 14 arranged in nine widthwise-extending rows of six spring units each or a more extensive array of ninety-nine coil spring units 14 arranged in nine widthwise-extending rows of eleven spring units each. Similarly, as an alternative to the array of eighty-two coil spring units 14 shown in FIG. 5, a more limited array of sixty coil spring units 14 could be arranged in ten widthwise-extending rows of six spring units each, or a more extensive array of 110 coil spring units 14 could be arranged in ten widthwise-extending rows of eleven spring units each.

Those persons skilled in the art will readily recognize that many other potential spring arrays are likewise made possible utilizing the grid 16 of the present invention. Further, it will recognized that the grid 16 of the present invention is equally adapted for use with various other base frames than the base frame 112, 212, 312 of FIGS. 3–5, thereby enabling bedding manufacturers to readily manufacture specialty constructions of box spring assemblies merely by alternative design of base frames utilizing differing numbers and spacings of slats 24, which as aforementioned, can be easily accomplished by bedding manufacturers utilizing the same stock wood frame members from which the standard base frames 112, 212, 312 are constructed.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purpose of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A wire grid for connecting an array of coil springs supported in a box spring bedding assembly on a plurality of transverse slats arranged in spaced parallel relation longitudinally along the box spring bedding assembly to form a base frame thereof, said wire grid being characterized by the capability of being selectively alternatively used for connecting at least two differing arrays of differing numbers of coil springs in at least two respective differing box spring assemblies having differing numbers of transverse slats at differing longitudinal spacings from one another without requiring structural modification of said wire grid, said grid comprising a plurality of relatively rigid longitudinal wires arranged in spaced parallel relation to one another and a plurality of relatively rigid transverse wires arranged in spaced parallel relation to one another and rigidly connected to said longitudinal wires in substantially perpendicular relation thereto, said longitudinal and transverse wires collectively forming said grid in an overall rectangular configuration, said transverse wires being arranged at selected spacings from one another forming a plurality of groupings of said transverse wires immediately adjacent one another and the respective transverse wires of each said grouping being cooperative with one another for connection thereto of a plurality of coil springs laterally spaced across the width of said grid, said groupings being of a number and being arranged at differing longitudinal spacings relative to one another in correspondence to the collective number and spacings of the respective transverse slats of said two box spring assemblies to be capable of selective alternative use in either of said two differing box spring assemblies for connecting either of said at least two differing arrays of coil springs without structural modifications of said wire grid, selected ones of said transverse wires being arranged to form a part of two different adjacent groupings thereof.

2. A wire grid for a box spring assembly according to claim 1 and characterized further in that said wire groupings are more closely spaced relative to one another in a central region along the length of said grid than in end regions at the opposite ends of said grid to permit a greater concentration of coil springs to be mounted in said central region.

3. A wire grid for a box spring assembly according to claim 1 and characterized further in that each said wire grouping is arranged for interlocking engagement with an end coil of each coil spring mounted thereon.

4. A wire grid for a box spring assembly according to claim 3 and characterized further in that each said wire grouping comprises a set of three adjacent transverse wires.

5. A wire grid for a box spring assembly according to claim 1 and characterized further in that said transverse wires provide at least eleven groupings of adjacent wires.

6. A wire grid for a box spring assembly according to claim 1 and characterized further in that said transverse wires provide at least thirteen groupings of adjacent wires.

7. A wire grid or a box spring assembly according to claim 1 and characterized further in that said transverse wires provide at least fifteen groupings of adjacent wires.

* * * * *

UNITED STATES PATENT AND TRADEMARK OFFICE

CERTIFICATE OF CORRECTION

PATENT NO. : 5,184,802

DATED : February 9, 1993

INVENTOR(S) : Michael Galumbeck

It is certified that error appears in the above-identified patent and that said Letters Patent is hereby corrected as shown below:

ON THE TITLE PAGE

Abstract, line 2 (not including heading), after "box spring" insert -- bedding --.

Column 1, line 39, delete "stand" and insert therefor -- standard --.

Column 2, line 16, after "and" insert -- the transverse wires are arranged in spaced parallel relation to one another, with the transverse and longitudinal wires being --.

Column 2, line 16, delete "to the longitudinal wires".

Column 2, line 17, delete "thereto" and insert therefor -- to one another --.

Column 4, line 40, after "medium" insert -- - --.

Column 5, line 30, after "exemplary" insert -- , --.

Column 5, line 60, after "will" insert -- be --.

Column 5, line 67, after "which" insert -- , --.

Column 6, line 16, delete "purpose" and insert therefor -- purposes --.

UNITED STATES PATENT AND TRADEMARK OFFICE

CERTIFICATE OF CORRECTION

PATENT NO. : 5,184,802

DATED : February 9, 1993

INVENTOR(S) : Michael Galumbeck

It is certified that error appears in the above-identified patent and that said Letters Patent is hereby corrected as shown below:

Column 6, line 58, delete "modifications" and insert therefor -- modification --.

Column 8, line 7, delete "or" and insert therefor -- for --.

Signed and Sealed this

Twenty-fifth Day of January, 1994

*Attest:*

Bruce Lehman

BRUCE LEHMAN

*Attesting Officer*

*Commissioner of Patents and Trademarks*